US008408425B2

(12) United States Patent
Lien

(10) Patent No.: US 8,408,425 B2
(45) Date of Patent: Apr. 2, 2013

(54) HYDRATION DEVICE

(76) Inventor: Chien-Ping Lien, Taipei County (TW)

( * ) Notice: Subject to any disclaimer, the term of this patent is extended or adjusted under 35 U.S.C. 154(b) by 324 days.

(21) Appl. No.: 12/876,889

(22) Filed: Sep. 7, 2010

(65) Prior Publication Data

US 2012/0055956 A1 Mar. 8, 2012

(51) Int. Cl.
*B65D 37/00* (2006.01)

(52) U.S. Cl. ..... 222/209; 22/175; 22/105; 22/207

(58) Field of Classification Search ..... 222/175, 222/105, 192, 92, 167, 386.5, 501, 527, 529, 222/531, 537, 548, 610, 323, 465.1, 481.5, 222/482, 145.5, 145.6, 209, 207; 128/202.5; 141/379, 10, 301, 346, 347, 382, 383; 220/714, 220/707, 709, 703, 728, 711; 224/148, 148.2; 215/387, 388, 229; 251/342; 417/472, 478, 417/479, 480

See application file for complete search history.

(56) References Cited

U.S. PATENT DOCUMENTS 4,629,098 A * 12/1986 Eger ..... 222/175
4,820,269 A * 4/1989 Riddell ..... 604/85
5,071,104 A * 12/1991 Witt et al. ..... 251/342
5,104,016 A * 4/1992 Runkel ..... 224/148.2
5,586,792 A * 12/1996 Kalahasthy et al. ..... 285/319
5,799,987 A * 9/1998 Sampson ..... 285/81
5,816,457 A * 10/1998 Croft ..... 224/148.2
5,845,943 A * 12/1998 Ramacier et al. ..... 285/12
5,911,403 A * 6/1999 deCler et al. ..... 251/149.6
6,085,947 A * 7/2000 Lien ..... 222/525
6,318,764 B1 * 11/2001 Trede et al. ..... 285/305
6,491,679 B1 * 12/2002 Okamoto et al. ..... 604/410
6,497,348 B2 * 12/2002 Forsman et al. ..... 224/148.2
6,547,284 B2 * 4/2003 Rose et al. ..... 285/1
6,607,179 B2 * 8/2003 Moretti et al. ..... 251/309
6,666,360 B1 * 12/2003 Swank ..... 224/148.2
6,722,533 B2 * 4/2004 Skillern ..... 222/175
6,742,681 B1 * 6/2004 Yang ..... 222/509
6,908,015 B2 * 6/2005 Choi et al. ..... 222/175
7,073,688 B2 * 7/2006 Choi et al. ..... 222/175
7,261,125 B1 * 8/2007 Lien ..... 137/614.04
7,311,231 B2 * 12/2007 Noell et al. ..... 224/148.2
7,434,844 B2 * 10/2008 Kao ..... 285/317
7,464,837 B2 * 12/2008 Hoskins ..... 222/175
7,533,786 B2 * 5/2009 Woolfson et al. ..... 222/144.5
7,703,633 B2 * 4/2010 Chen ..... 220/703
7,931,253 B1 * 4/2011 Paczonay ..... 251/343
8,011,529 B2 * 9/2011 Lien ..... 220/714
8,167,174 B2 * 5/2012 Berger ..... 222/145.5
8,177,097 B2 * 5/2012 Duran ..... 222/105
2002/0014498 A1 * 2/2002 Forsman et al. ..... 222/92
2004/0217117 A1 * 11/2004 Lien ..... 220/375

(Continued)

*Primary Examiner* — Kevin P Shaver
*Assistant Examiner* — Christopher Luzecky

(57) ABSTRACT

A hydration device includes a bag having a water outlet frame connected thereto an outlet connector is connected to the water outlet frame. The outlet connector is connected with a first end of a hose and a second end of the hose is connected to a first end of a mixing unit. A second end of the mixing unit is connected with a mouth piece unit or a two-way switch. The mixing unit is made of flexible material and has a room defined therein. An inner tube is located in the room and connected between a one-way inlet valve and a moisture-water mixing valve. The two-way switch includes a hose mount, a main part, a sealing unit and a release unit, wherein the user can have water directly from the sealing unit and the water can be dispensed to share with others by operation of the release unit.

12 Claims, 9 Drawing Sheets

U.S. PATENT DOCUMENTS

2006/0038042 A1* 2/2006 Lien ..... 239/542
2006/0163284 A1* 7/2006 Karl et al. ..... 222/175
2006/0231561 A1* 10/2006 Choi et al. ..... 220/714
2007/0075094 A1* 4/2007 Brown ..... 222/175
2007/0119809 A1* 5/2007 Chen ..... 215/200
2007/0215221 A1* 9/2007 Lien ..... 137/614.04
2008/0308578 A1* 12/2008 Skillern et al. ..... 222/209
2009/0167018 A1* 7/2009 Lien ..... 285/308
2009/0314789 A1* 12/2009 Lien ..... 220/714
2010/0012221 A1* 1/2010 Lien ..... 141/10
2010/0084411 A1* 4/2010 Lien ..... 220/592.16
2010/0213223 A1* 8/2010 Ballentine ..... 224/148.2
2011/0097141 A1* 4/2011 Brown ..... 403/286
2011/0284105 A1* 11/2011 Lien ..... 137/535

* cited by examiner

HYDRATION DEVICE

FIELD OF THE INVENTION

The present invention relates to a hydration device wherein the user can introduce pressure into the water bag so that the water is supplied by the pressure in the water bag.

BACKGROUND OF THE INVENTION

One of the conventional personal hydration devices uses pressure to allow the users to have sufficient water from the device, and generally includes a bottle, a control switch, a hose and compressing unit. The hose and the compressing unit are sealed to the bottle which forms an air-tight space, wherein the hose and the compressing unit are in communication with the space. The control switch is connected with the hose. The compressing unit can be a pressurized tank and the control switch is a push-type switch or a threading-type switch. By introducing pressure into the bottle, the water in the bottle can be supplied to the user's mouth via the operation of the control switch. Another conventional personal hydration device is disclosed in US2008/0308578A1, and includes a reservoir having an air inlet and water outlet, the air inlet can be operated by using pump or squeezing an air bladder to increase pressure in the reservoir. A hose is connected to the water outlet and a mouth piece is connected the other end of the hose, or the hose is connected between the air bladder and the water outlet. The hose can be switched to provide pressure to the water in the reservoir. Both of the two published hydration devices include two individual pumping part and drinking part, and are connected to the reservoir. This increases the manufacturing cost and is inconvenient for carriage. During operation, the pumping action and the drinking action are two separated actions, and the water can only be obtained when there is sufficient pressure. If the pressure is too low, the water cannot be completely expelled. When the pressure is sufficient and the water is full, the water will flow so fast that the user get choke on water. When the water is less and the pressure will be low so that the water flows slow and cannot meet the user's need.

The present invention intends to provide a hydration device which improves the problems of the conventional hydration devices and the water supplying device can be increased the pressure in the water bag to improve the speed of the water flow so as to convenient have the water from the water bag.

SUMMARY OF THE INVENTION

The present invention relates to a hydration device and comprises a bag having a water outlet frame connected to an underside thereof and an outlet connector is connected to the water outlet frame. The outlet connector is connected with a first end of a hose and a second end of the hose is connected to a first end of a mixing unit. A second end of the mixing unit is connected with a mouth piece unit or a two-way switch. The mixing unit is made of flexible material and has a room defined therein. An inner tube is located in the room and connected between a one-way inlet valve and a moisture-water mixing valve.

The one-way inlet valve comprises a first inlet member, a communication tube, an inlet valve and a collar. A hose connector is connected to a top end of the first inlet member and an air inlet chamber is connected to a lower end of first inlet member. The air inlet chamber has outer threads defined in an outer surface thereof and an air inlet hole is defined through a wall of the air inlet chamber. An enlarged opening is defined in an underside of the air inlet chamber. The collar has a communication hole defined in a mediate portion thereof and inner threads are defined in an inner periphery thereof. A pressing ring and a body presser are connected to a top end and a lower end of the collar. The air inlet chamber is engaged with the inlet valve so as to seal the air inlet hole. The inlet valve has an aperture in a top end thereof. The communication tube includes a flange on an outer surface thereof so as to be connected to a lower end of the air inlet chamber. The communication tube has a top tube connected to a top end thereof so as to press the inlet valve against a top end of the air inlet chamber. A lower end of the communication tube has an inner tube connector which is connected with the inner tube such that the first inlet member communicates with the communication tube to form a water path. The flange has an aperture which communicates with the air inlet chamber and the room. The first inlet member and the communication tube are respectively engaged with the body. The enlarged opening and the body presser press an opening in the top end of the body. The hose connector and the pressing ring press the hose.

The moisture-water mixing valve comprises a second inlet member, a connection member, a mixing valve and a collar. The second inlet member has an inner tube connector connected to a top end thereof so as to be connected with the inner tube. A mixing chamber is connected to a lower end of the second inlet member and includes an inlet hole defined therein and an insertion portion is located at a mediate portion of the mixing chamber. The mixing valve is mounted to the insertion portion so as to seal the inlet hole. The connection member has an annular portion on a top end thereof and outer threads are defined in a mediate portion of the connection member. A hose connector is connected to a lower end of the connection member. The collar includes inner threads defined therein and a body presser is connected to a top end of the collar. A pressing ring is connected to a lower end of the collar. The second inlet member is engaged within the annular portion which is engaged with the lower end of the body. When the connection member is threadedly connected to the collar, the annular portion and the body presser press an opening in the lower end of the body, and the hose connector and the pressing ring press the hose.

The mouth piece unit comprises a hose mount, a water valve, a spring and a mouth piece. The hose mount has a hose connector at a lower end thereof so as to be connected with the hose and a mouth piece connector is connected to a top end of the hose mount. The spring and the water valve are located in the mouth piece connector. The mouth piece is mounted to the mouth piece connector. The water valve is biased by the spring to contact against an outlet of the mouth piece which is opened by compressing the mouth piece.

The two-way switch comprises a hose mount, a main part, a sealing unit and a release unit. The hose mount has a hose connector connected to a lower end thereof so as to be connected with the hose. A slot is defined in a top end of the hose mount so as to be secured to the main part. A button room is defined between the slot and has a connection hole therein. The main part has an engaging portion at a mediate portion thereof and the engaging portion has a connection tube which is engaged with the connection hole. The connection tube includes a seal groove and a sealing ring is engaged with the seal groove to seal a gap between the engaging portion and the slot. The main part has a mouth piece connector on one side thereof and a release rod is located on the other side of the main part. The sealing unit comprises a spring, a water valve and a mouth piece. The spring and the water valve are engaged within the mouth piece connector. The mouth piece is mounted to the mouth piece connector and the water valve contacts against the water outlet hole of the mouth piece by a force of the spring. The water outlet hole is opened when the mouth piece is compressed. The release unit comprises a cover, a button, a spring, a sealing plug, a release collar, a release cap and two seals. The button is located in the button room and has an inclined block protruding from a mediate portion thereof. The cover is securely mounted to outside of the button room. One of the seals is mounted to a seal groove in a side of the button so as to seal a gap between the button and the cover. The spring and the sealing plug are located in the release rod. The release collar is securely mounted to the release rod and has a taper-shaped water outlet hole. The sealing plug has an inclined slot defined in a rear end thereof and the inclined slot extends beneath the inclined block. The other one of the seals is engaged with another seal groove in a front end of the sealing plug. The seal at the front end of the sealing plug is biased by the spring to seal the water outlet hole of the release collar. When the button is pushed, the inclined block slides along the inclined slot to move the sealing plug so that the water outlet hole is opened. The release cap is mounted outside the release collar to keep the outlet be clean. Besides, a cup can be used to share the water from the release rod with other users.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
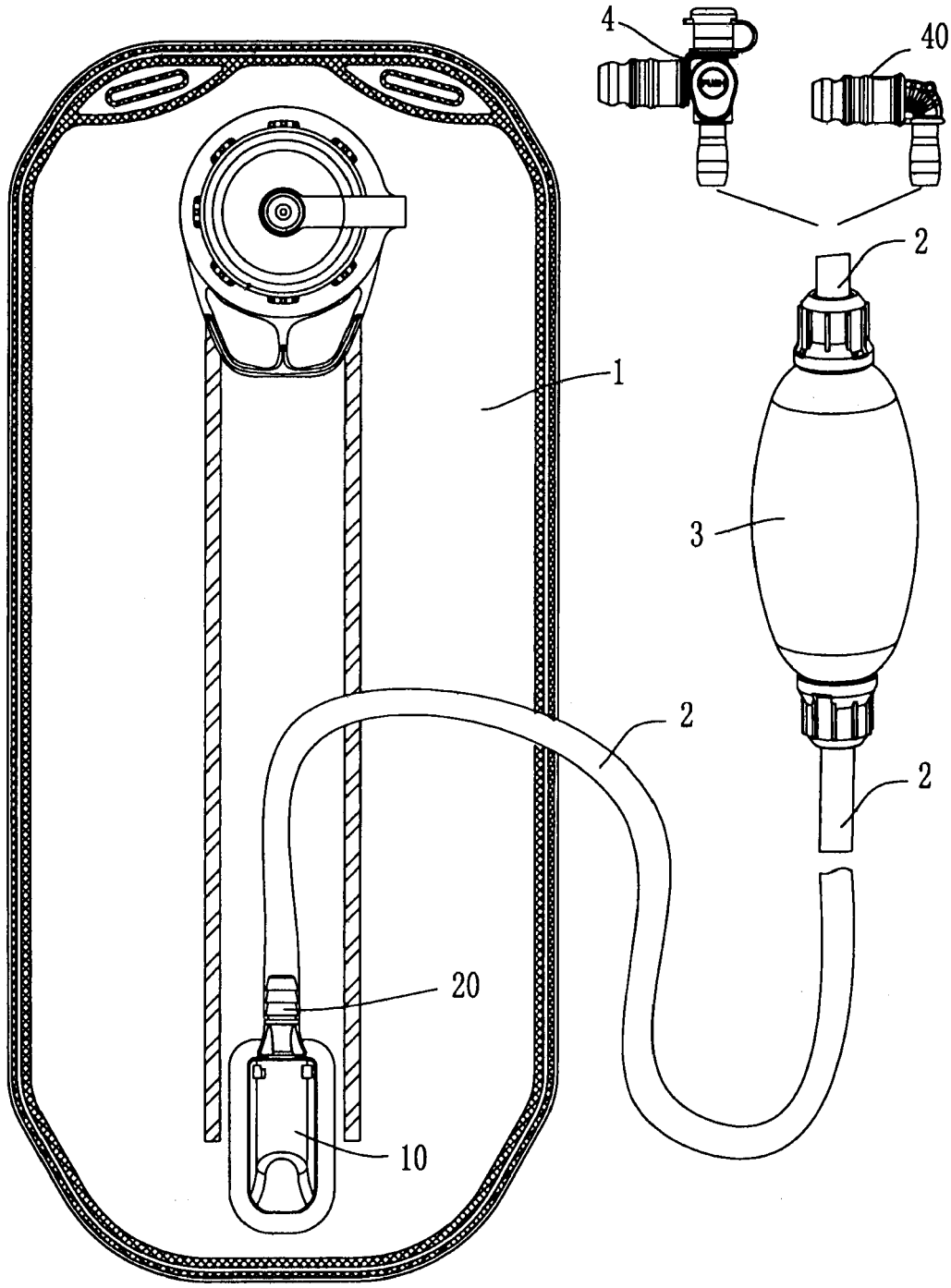
FIG. 1 shows the basic parts of the hydration device of the present invention.

Referring to FIG. 1, the hydration device of the present invention comprises a bag 1 having a water outlet frame 10 connected to an underside thereof and an outlet connector 20 is connected to the water outlet frame 10. The outlet connector 20 is connected with a first end of a hose 2 and a second end of the hose 2 is connected to a first end of a mixing unit 3. A second end of the mixing unit 3 is connected with a mouth piece unit 40 or a two-way switch 4.

Figure 2:
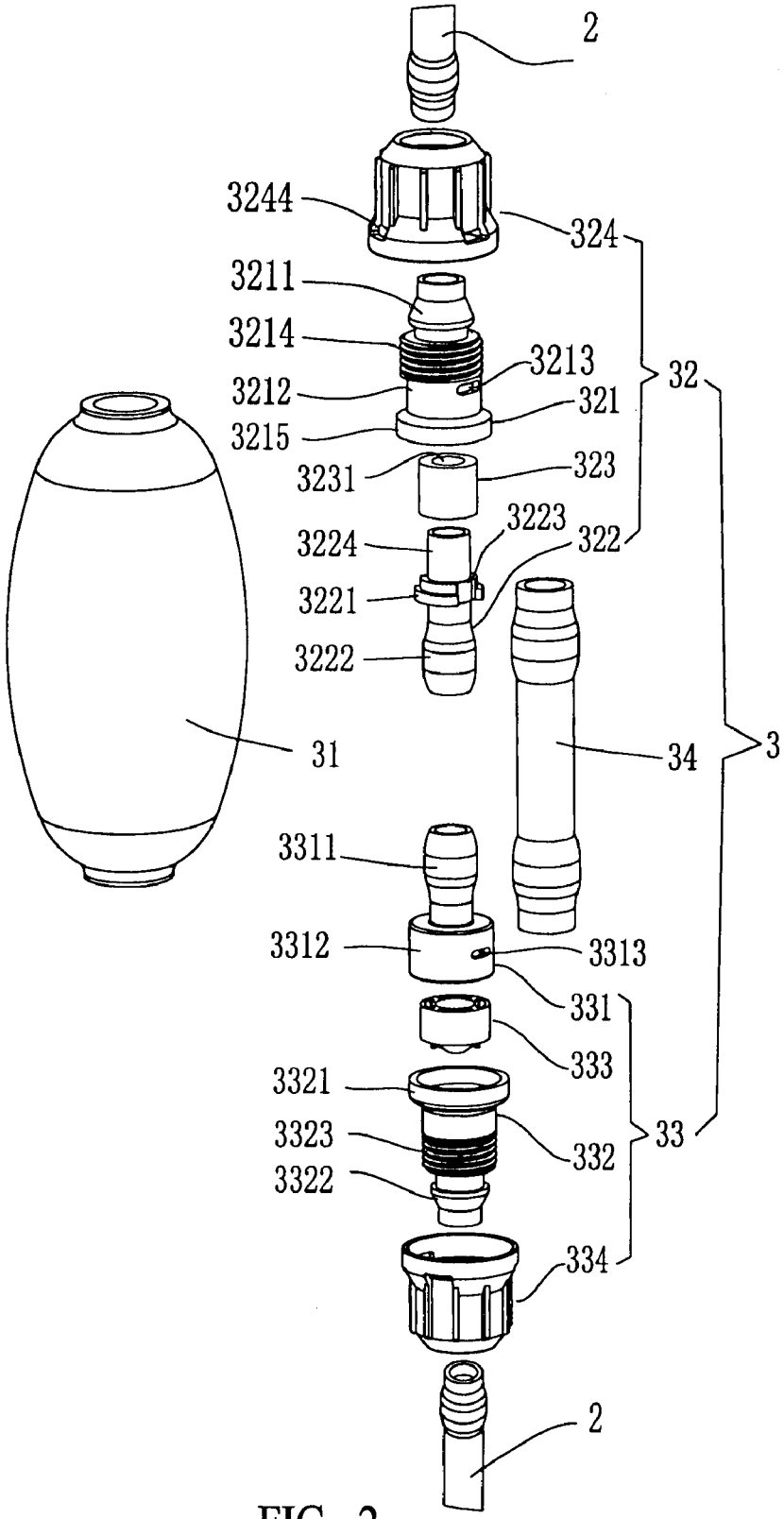
FIG. 2 is an exploded view to show the mixing unit of the hydration device of the present invention.
Figure 3:
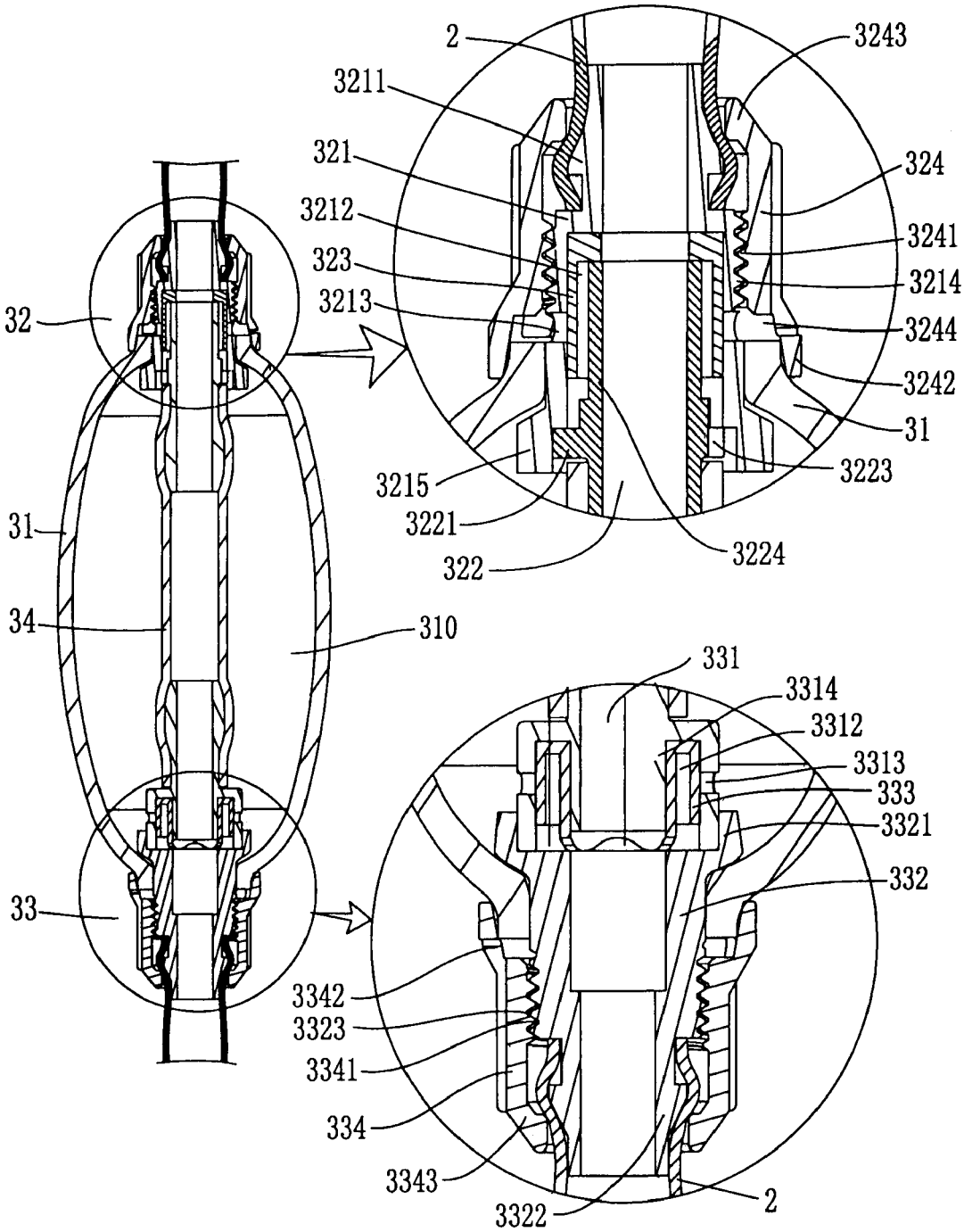
FIG. 3 is the cross sectional view of the mixing unit and two enlarged cross sectional view of the two circled portions of the hydration device of the present invention.

Referring to FIGS. 2 and 3, the mixing unit 3 includes a body 31, a one-way inlet valve 32, a moisture-water mixing valve 33 and an inner tube 34. The one-way inlet valve 32 comprises a first inlet member 321, a communication tube 322, an inlet valve 323 and a collar 324. The body 31 is made of flexible material and has a room 310 defined therein. The room 310 has the one-way inlet valve 32 connected to a top end thereof and the moisture-water mixing valve 33 is connected to a lower end of the room 310. The inner tube 34 communicates between the one-way inlet valve 32 and the moisture-water mixing valve 33. A hose connector 3211 is connected to a top end of the first inlet member 321 and an air inlet chamber 3212 is connected to a lower end of first inlet member 321. The air inlet chamber 3212 has outer threads 3214 defined in an outer surface thereof and an air inlet hole 3213 is defined through a wall of the air inlet chamber 3212. An enlarged opening 3215 is defined in an underside of the air inlet chamber 3212. The communication tube 322 has a top tube 3224 connected to a top end thereof so as to press the inlet valve 323 against a top end of the air inlet chamber 3212. A lower end of the communication tube 322 has an inner tube connector 3222 which is connected with the inner tube 34 such that the first inlet member 321 communicates with the communication tube 322 to form a water path. The flange 3221 has an aperture 3223 which communicates with the air inlet chamber 3212 and the room 310. The moisture-water mixing valve 33 comprises a second inlet member 331, a connection member 332, a mixing valve 333 and a collar 334. The second inlet member 331 has an inner tube connector 3311 connected to a top end thereof so as to be connected with the inner tube 34. A mixing chamber 3312 is connected to a lower end of the second inlet member 331 and includes an inlet hole 3313 defined therein and an insertion portion 3314 is located at a mediate portion of the mixing chamber 3312. The mixing valve 333 is mounted to the insertion portion 3314 so as to seal the inlet hole 3313. The connection member 332 has an annular portion 3321 on a top end thereof and outer threads 3323 are defined in a mediate portion of the connection member 332.

The collar 324 has a communication hole 3244 defined in a mediate portion thereof and inner threads 3241 are defined in an inner periphery thereof. The air outside the device may enter the air inlet chamber 3212 via the air inlet hole 3213. A pressing ring 3243 and a body presser 3242 are connected to a top end and a lower end of the collar 324. The air inlet chamber 3212 is engaged with the inlet valve 323 so as to seal the air inlet hole 3213. The inlet valve 323 has an aperture 3231 in a top end thereof. The communication tube 322 includes a flange 3221 on an outer surface thereof so as to be connected to a lower end of the air inlet chamber 3212. The first inlet member 321 and the communication tube 322 are respectively engaged with the body 31. The enlarged opening 3215 and the body presser 3242 press an opening in the top end of the body 31. The hose connector 3211 and the pressing ring 3243 press the hose 2. A hose connector 3322 is connected to a lower end of the connection member 332. The collar 334 includes inner threads 3341 defined therein and a body presser 3342 is connected to a top end of the collar 334. A pressing ring 3343 is connected to a lower end of the collar 334. The second inlet member 331 is engaged within the annular portion 3321 which is engaged with the lower end of the body 31. When the connection member 332 is threadedly connected to the collar 334, the annular portion 3321 and the body presser 3342 press an opening in the lower end of the body 31, and the hose connector 3322 and the pressing ring 3343 press the hose 2.

When in use, the user squeezes the body 31 to increase the inner pressure in the room 310, the inlet valve 323 of the one-way inlet valve 32 seals the air inlet hole 3213. The air in the room 310 enters the mixing chamber 3312 via the inlet hole 3313 of the moisture-water mixing valve 33, and enters into the bag 1 via the hose 2. When releasing the body 31, the bounce force of the body 31 generates negative pressure in the room 310, and the mixing valve 333 of the moisture-water mixing valve 33 seals the inlet hole 3313 to prevent the air in the hose 2 to flow backward. In the meanwhile, the air inlet hole 3213 of the one-way inlet valve 32 is opened so that air can be sucked into the room 310. By repeatedly operation to the body 31, sufficient air can be introduced into the bag 1.

Figure 4:
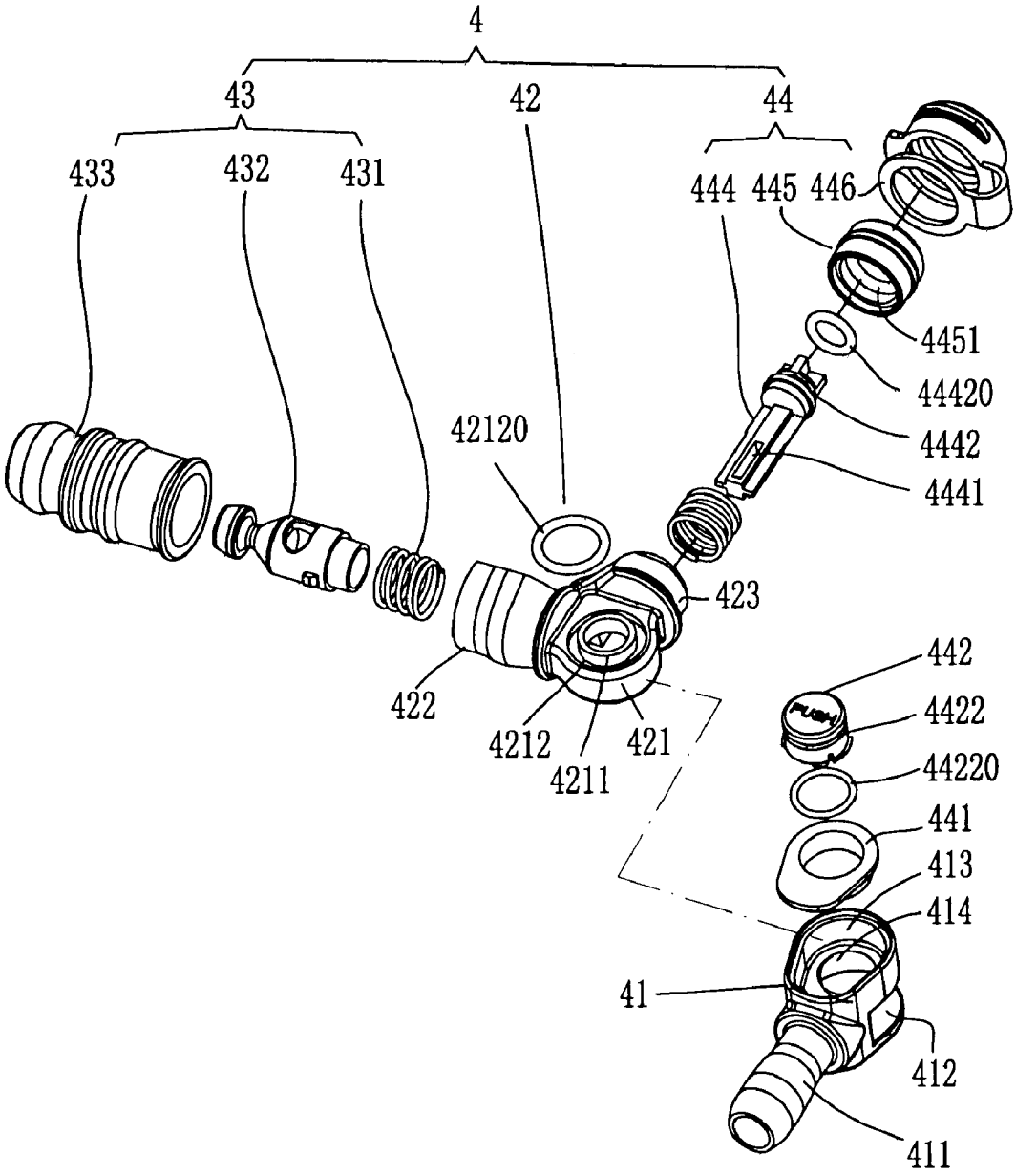
FIG. 4 is an exploded view to show the two-way switch of the hydration device of the present invention.
Figure 5:
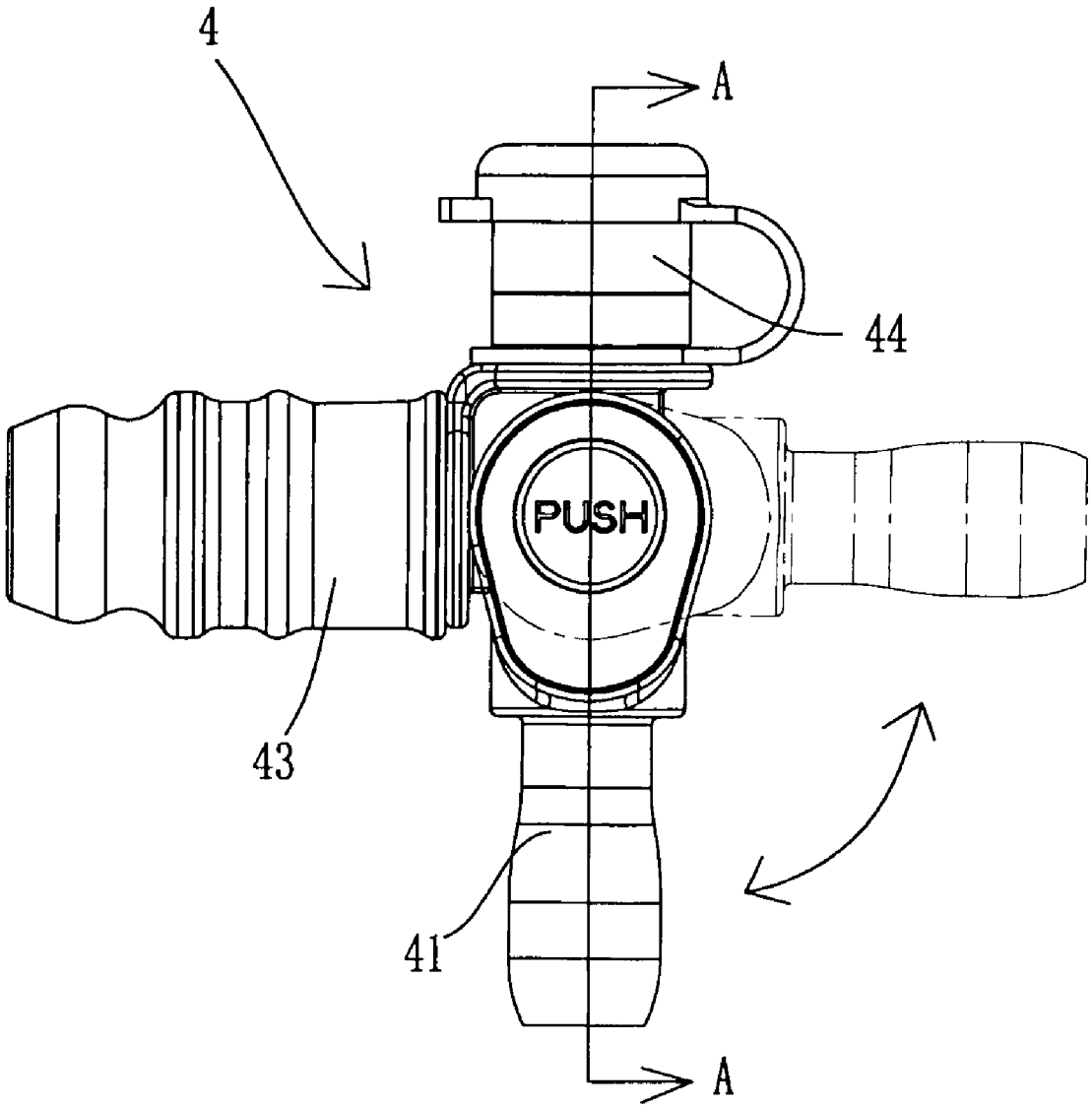
FIG. 5 shows the operation status of the two-way switch of the hydration device of the present invention.
Figure 6:
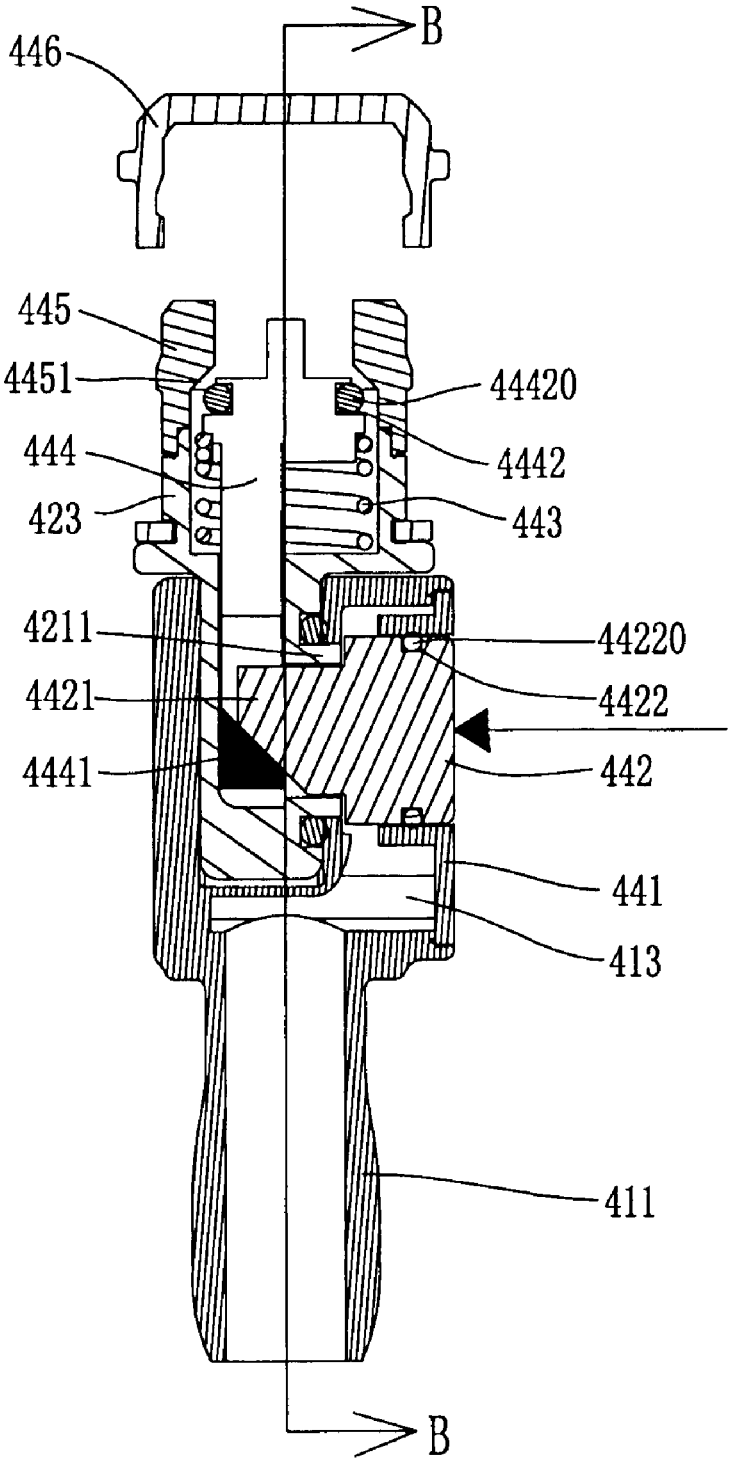
FIG. 6 is a cross sectional view, taken along line A-A of FIG. 5.

As shown in FIGS. 4 to 6, the two-way switch 4 comprises a hose mount 41, a main part 42, a sealing unit 43 and a release unit 44. The hose mount 41 has a hose connector 411 connected to a lower end thereof so as to be connected with the hose 2. A slot 412 is defined in a top end of the hose mount 41 so as to be secured to the main part 42. A button room 413 is defined between the slot 412 and has a connection hole 414 therein. The main part 42 has an engaging portion 421 at a mediate portion thereof and the engaging portion 421 has a connection tube 4211 which is engaged with the connection hole 414. The connection tube 4211 includes a seal groove 4212 and a sealing ring 42120 is engaged with the seal groove 4212 to seal a gap between the engaging portion 421 and the slot 412. The main part 42 has a mouth piece connector 422 on one side thereof and a release rod 423 is located on the other side of the main part 42. The sealing unit 43 comprises a spring 431, a water valve 432 and a mouth piece 433. The spring 431 and the water valve 432 are engaged within the mouth piece connector 422. The mouth piece 433 is mounted to the mouth piece connector 422 and the water valve 432 contacts against the water outlet hole 4331 of the mouth piece 433 by a force of the spring 431. The water outlet hole 4331 is opened when the mouth piece 433 is compressed. The release unit 44 comprises a cover 441, a button 442, a spring 443, a sealing plug 444, a release collar 445, a release cap 446 and two seals 44220 and 44420. The button 442 is located in the button room 413 and has an inclined block 4421 protruding from a mediate portion thereof. The cover 441 is securely mounted to outside of the button room 413. One of the seals 44220 is mounted to a seal groove 4422 in a side of the button 442 so as to seal a gap between the button 442 and the cover 441. The spring 443 and the sealing plug 444 are located in the release rod 423. The release collar 445 is securely mounted to the release rod 423 and has a taper-shaped water outlet hole 4451. The sealing plug 444 has an inclined slot 4441 defined in a rear end thereof and the inclined slot 4441 extends beneath the inclined block 4421. The other one of the seals 44420 is engaged with another seal groove 4442 in a front end of the sealing plug 444. The two-way switch 4 can be freely rotated in the slot 412 of the release unit 44 so that the water can be dispensed via the sealing unit 43 or by pressing the release unit 44 at desired angular positions. The seals 44420 at the front end of the sealing plug 444 is biased by the spring 443 to seal the water outlet hole 4451 of the release collar 445.

When the button 442 is pushed, the inclined block 4421 slides along the inclined slot 4441 to move the sealing plug 444 so that the water outlet hole 4451 is opened. By removing the release cap 446, the water in the bag 1 can be released. The release cap 446 can be mounted outside the release collar 445 to keep the outlet be clean.

Figure 7:
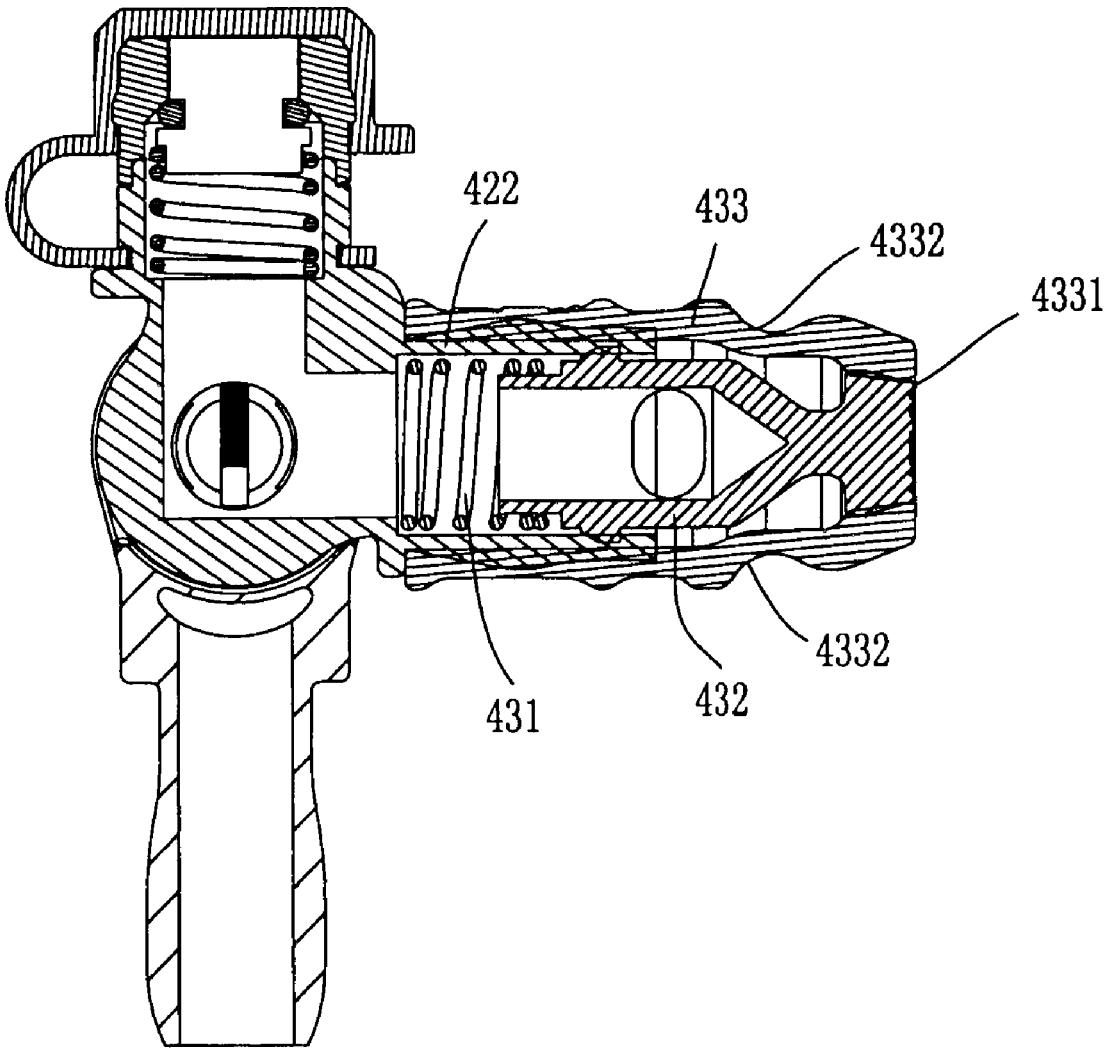
FIG. 7 is a cross sectional view, taken along line B-B of FIG. 6.

As shown in FIG. 7, when the user bits at the bite groove 4332 of the mouth piece 433, the water valve 432 is moved backward and away from the water outlet hole 4331 which is then opened. When the two-way switch 4 is connected with the bag 1, the water in the bag 1 ejects into the user's mouth when the water outlet hole 4331 is opened.

Figure 8:
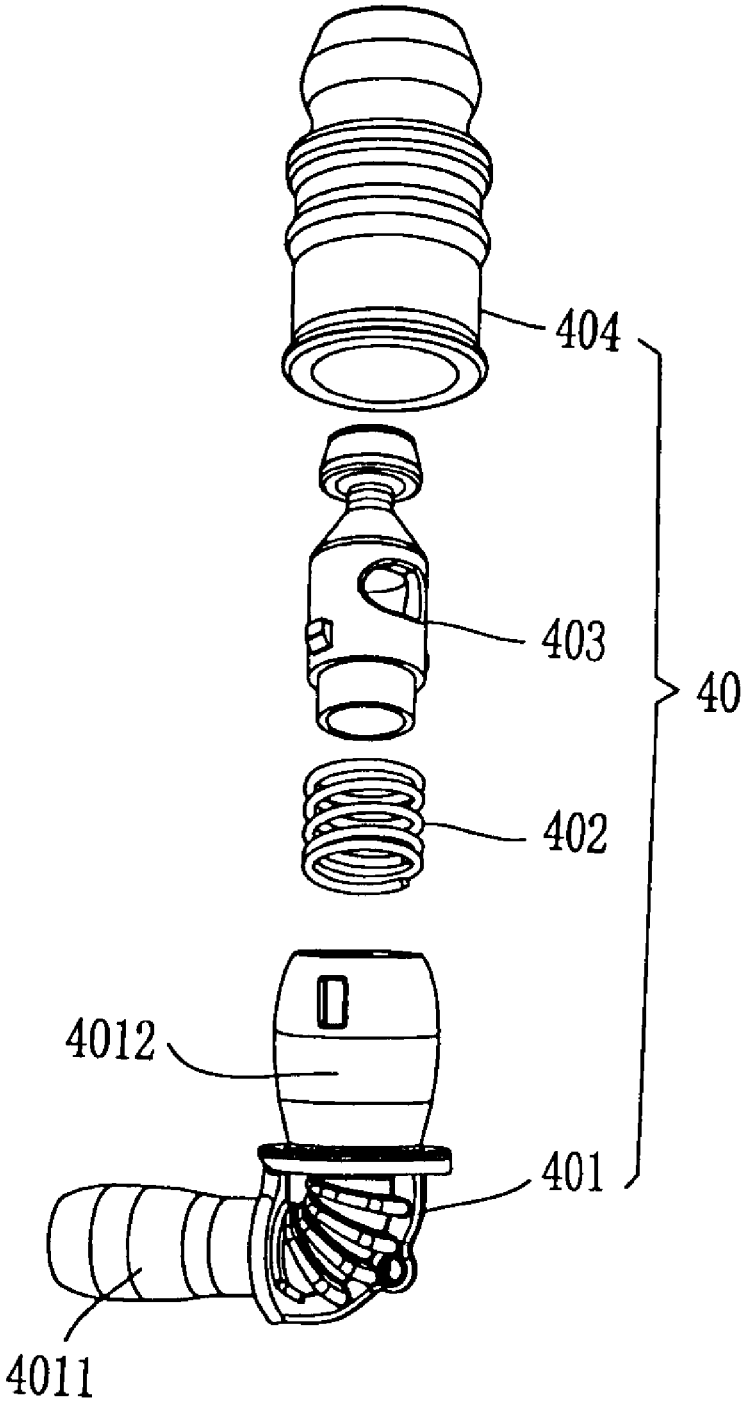
FIG. 8 is an exploded view of the mouth piece unit of the hydration device of the present invention.

Referring to FIG. 8, the mouth piece unit 40 comprises a hose mount 401, a spring 402, a water valve 403 and a mouth piece 404. The hose mount 401 has a hose connector 4011 at a lower end thereof so as to be connected with the hose 2 and a mouth piece connector 4012 is connected to a top end of the hose mount 401. The spring 402 and the water valve 403 are located in the mouth piece connector 4012. The mouth piece 404 is mounted to the mouth piece connector 4012. The water valve 403 is biased by the spring 402 to contact against an outlet of the mouth piece 404 which is opened by compressing the mouth piece 404. The way of use is the same as described regarding to FIG. 7.

Figure 9:
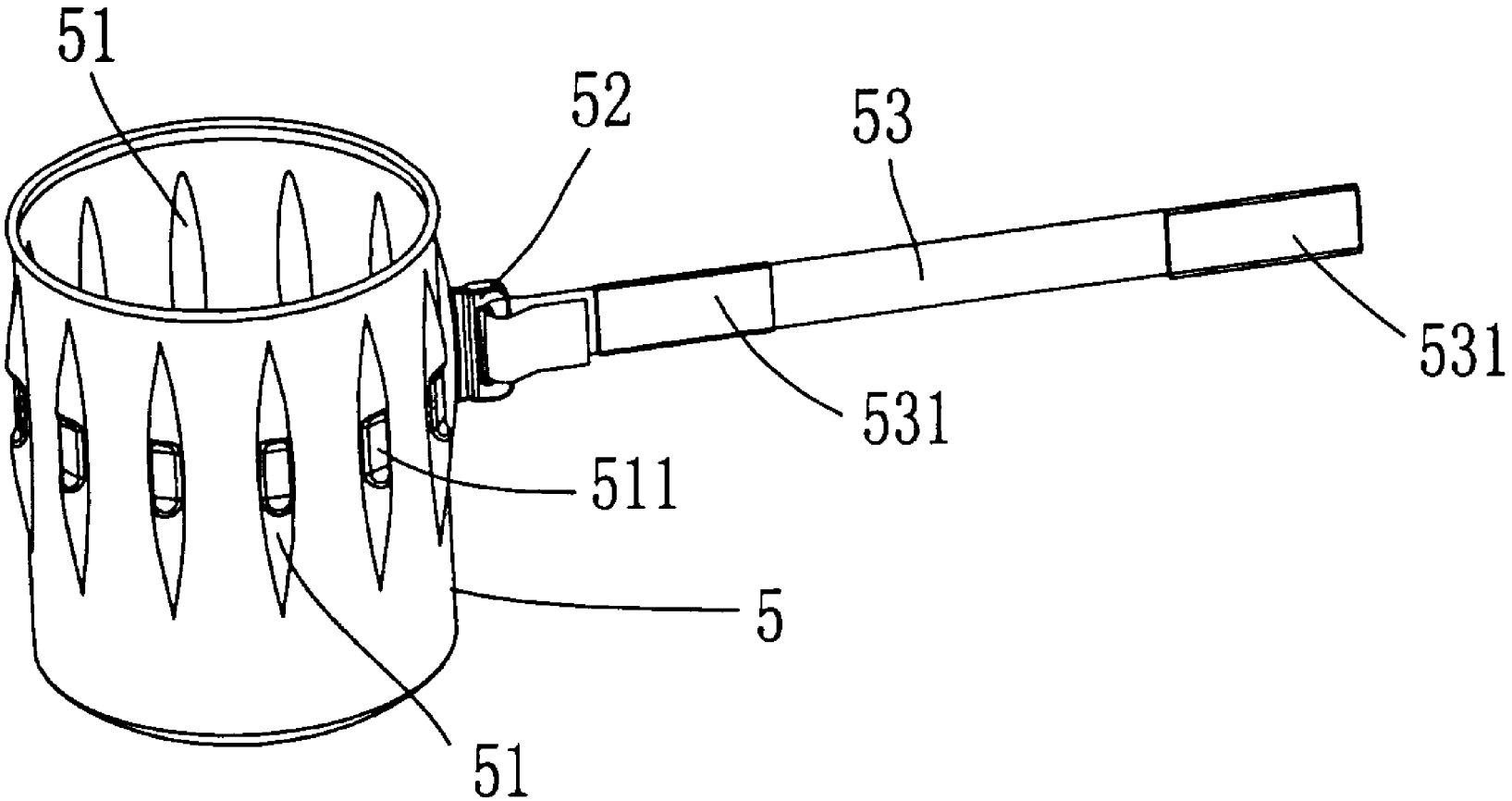
FIG. 9 shows the cup used with the of the hydration device of the present invention.

As shown in FIG. 9, a cup 5 can be used to share the water from the release rod 423 with other users. The cup 5 is made of flexible rubber for convenience of storage and multiple resilient bands 51 are connected to the periphery of the cup 5 to reinforce the structural strength of the cup 5. A ring 52 is connected to the cup 5 and a strap 53 is tied to the ring 52. Two connection members 531 such as Velcro strips are connected to two ends of the strap 53. The resilient bands 51 on outside of the cup 5 each have a slot 511. When the cup 5 is not in use, the strap 53 secures the resilient bands 51 along the slots 511, and the two connection members 531 are connected to each other to secure the cup 5. By this way, the cup 5 is securely positioned and prevented from be contaminated.

While we have shown and described the embodiment in accordance with the present invention, it should be clear to those skilled in the art that further embodiments may be made without departing from the scope of the present invention.

What is claimed is:

1. A hydration device comprising:

a bag (1) having a water outlet frame (10) connected to an underside thereof and an outlet connector (20) connected to the water outlet frame (10), the outlet connector (20) connected with a first end of a hose (2) and a second end of the hose (2) connected to a first end of a mixing unit (3), a second end of the mixing unit (3) connected with a mouth piece unit (40) or a two-way switch (4), the mixing unit (3) being made of flexible material and having a room (310) defined therein, an inner tube (34) located in the room (310) and connected between a one-way inlet valve (32) and a moisture-water mixing valve (33), the one-way inlet valve (32) comprising a first inlet member (321), a communication tube (322), an inlet valve (323) and a collar (324), a hose connector (3211) connected to a top end of the first inlet member (321) and an air inlet chamber (3212) connected to a lower end of the first inlet member (321), the air inlet chamber (3212) having outer threads (3214) defined in an outer surface thereof and an air inlet hole (3213) defined through a wall of the air inlet chamber (3212), an enlarged opening (3215) defined in an underside of the air inlet chamber (3212), the collar (324) having a communication hole (3244) defined in a mediate portion thereof and inner threads (3241) defined in an inner periphery thereof, a pressing ring (3243) and a body presser (3242) connected to a top end and a lower end of the collar (324), the air inlet chamber (3212) engaged with the inlet valve (323) so as to seal the air inlet hole (3213), the inlet valve (323) having an aperture (3231) in a top end thereof, the communication tube (322) including a flange (3221) on an outer surface thereof so as to be connected to a lower end of the air inlet chamber (3212), the communication tube (322) having a top tube (3224) connected to a top end thereof so as to press the inlet valve (323) against a top end of the air inlet chamber (3212), a lower end of the communication tube (322) having an inner tube connector (3222) which is connected with the inner tube (34) such that the first inlet member (321) communicates with the communication tube (322) to form a water path, the flange (3221) having an aperture (3223) which communicates with the air inlet chamber (3212) and the room (310), the first inlet member (321) and the communication tube (322) respectively engaged with the body (31), the enlarged opening (3215) and the body presser (3242) pressing an opening in the top end of the body (31), the hose connector (3211) and the pressing ring (3243) pressing the hose (2).

2. The device as claimed in claim 1, wherein the moisture-water mixing valve (33) comprises a second inlet member (331), a connection member (332), a mixing valve (333) and a collar (334), the second inlet member (331) has an inner tube connector (3311) connected to a top end thereof so as to be connected with the inner tube (34), a mixing chamber (3312) is connected to a lower end of the second inlet member (331) and includes an inlet hole (3313) defined therein and an insertion portion (3314) is located at a mediate portion of the mixing chamber (3312), the mixing valve (333) is mounted to the insertion portion (3314) so as to seal the inlet hole (3313), the connection member (332) has an annular portion (3321) on a top end thereof and outer threads (3323) are defined in a mediate portion of the connection member (332), a hose connector (3322) is connected to a lower end of the connection member (332), the collar (334) includes inner threads (3341) defined therein and a body presser (3342) is connected to a top end of the collar (334), a pressing ring (3343) is connected to a lower end of the collar (334), the second inlet member (331) is engaged within the annular portion (3321) which is engaged with the lower end of the body (31), when the connection member (332) is threadedly connected to the collar (334), the annular portion (3321) and the body presser (3342) press an opening in the lower end of the body (31), and the hose connector (3322) and the pressing ring (3343) press the hose (2).

3. The device as claimed in claim 1, wherein the two-way switch (4) comprises a hose mount (41), a main part (42), a sealing unit (43) and a release unit (44), the hose mount (41) has a hose connector (411) connected to a lower end thereof so as to be connected with the hose (2), a slot (412) is defined in a top end of the hose mount (41) so as to be secured to the main part (42), a button room (413) is defined between the slot (412) and has a connection hole (414) therein, the main part (42) has an engaging portion (421) at a mediate portion thereof and the engaging portion (421) has a connection tube (4211) which is engaged with the connection hole (414), the connection tube (4211) includes a seal groove (4212) and a sealing ring (42120) is engaged with the seal groove (4212) to seal a gap between the engaging portion (421) and the slot (412), the main part (42) has a mouth piece connector (422) on one side thereof and a release rod (423) is located on the other side of the main part (42), the sealing unit (43) comprises a spring (431), a water valve (432) and a mouth piece (433), the spring (431) and the water valve (432) are engaged within the mouth piece connector (422), the mouth piece (433) is mounted to the mouth piece connector (422) and the water valve (432) contacts against the water outlet hole (4331) of the mouth piece (433) by a force of the spring (431), the water outlet hole (4331) is opened when the mouth piece (433) is compressed, the release unit (44) comprises a cover (441), a button (442), a spring (443), a sealing plug (444), a release collar (445), a release cap (446) and two seals (44220), the button (442) is located in the button room (413) and has an inclined block (4421) protruding from a mediate portion thereof, the cover (441) is securely mounted to outside of the button room (413), one of the seals (44220) is mounted to a seal groove (4422) in a side of the button (442) so as to seal a gap between the button (442) and the cover (441), the spring (443) and the sealing plug (444) are located in the release rod (423), the release collar (445) is securely mounted to the release rod (423) and has a taper-shaped water outlet hole (4451), the sealing plug (444) has an inclined slot (4441) defined in a rear end thereof and the inclined slot (4441) extends beneath the inclined block (4421), the other one of the seals (44420) is engaged with another seal groove (4442) in a front end of the sealing plug (444), the seals (44420) at the front end of the sealing plug (444) is biased by the spring (443) to seal the water outlet hole (4451) of the release collar (445), when the button (442) is pushed, the inclined block (4421) slides along the inclined slot (4441) to move the sealing plug (444) so that the water outlet hole (4451) is opened, the release cap (446) is mounted outside the release collar (445).

4. The device as claimed in claim 1, wherein the mouth piece unit (40) comprises a hose mount (401), a water valve (403), a spring (402) and a mouth piece (404), the hose mount (401) has a hose connector (4011) at a lower end thereof so as to be connected with the hose (2) and a mouth piece connector (4012) is connected to a top end of the hose mount (401), the spring (402) and the water valve (403) are located in the mouth piece connector (4012), the mouth piece (404) is mounted to the mouth piece connector (4012), the water valve (403) is biased by the spring (402) to contact against an outlet of the mouth piece (404) which is opened by compressing the mouth piece (404).

5. A hydration device comprising:

a bag (1) having a water outlet frame (10) connected to an underside thereof and an outlet connector (20) connected to the water outlet frame (10), the outlet connector (20) connected with a first end of a hose (2) and a second end of the hose (2) connected to a first end of a mixing unit (3), a second end of the mixing unit (3) connected with a mouth piece unit (40) or a two-way switch (4), the mixing unit (3) being made of flexible material and having a room (310) defined therein, an inner tube (34) located in the room (310) and connected between a one-way inlet valve (32) and a moisture-water mixing valve (33), the moisture-water mixing valve (33) comprising a second inlet member (331), a connection member (332), a mixing valve (333) and a collar (334), the second inlet member (331) has an inner tube connector (3311) connected to a top end thereof so as to be connected with the inner tube (34), a mixing chamber (3312) connected to a lower end of the second inlet member (331) and including an inlet hole (3313) defined therein and an insertion portion (3314) located at a mediate portion of the mixing chamber (3312), the mixing valve (333) mounted to the insertion portion (3314) so as to seal the inlet hole (3313), the connection member (332) having an annular portion (3321) on a top end thereof and outer threads (3323) defined in a mediate portion of the connection member (332), a hose connector (3322) connected to a lower end of the connection member (332), the collar (334) including inner threads (3341) defined therein and a body presser (3342) connected to a top end of the collar (334), a pressing ring (3343) connected to a lower end of the collar (334), the second inlet member (331) engaged within the annular portion (3321) which is engaged with the lower end of the body (31), when the connection member (332) is threadedly connected to the collar (334), the annular portion (3321) and the body presser (3342) press an opening in the lower end of the body (31), and the hose connector (3322) and the pressing ring (3343) press the hose (2).

6. The device as claimed in claim 5, wherein the one-way inlet valve (32) comprises a first inlet member (321), a communication tube (322), an inlet valve (323) and a collar (324), a hose connector (3211) is connected to a top end of the first inlet member (321) and an air inlet chamber (3212) is connected to a lower end of the first inlet member (321), the air inlet chamber (3212) has outer threads (3214) defined in an outer surface thereof and an air inlet hole (3213) is defined through a wall of the air inlet chamber (3212), an enlarged opening (3215) is defined in an underside of the air inlet chamber (3212), the collar (324) has a communication hole (3244) defined in a mediate portion thereof and inner threads (3241) are defined in an inner periphery thereof, a pressing ring (3243) and a body presser (3242) are connected to a top end and a lower end of the collar (324), the air inlet chamber (3212) is engaged with the inlet valve (323) so as to seal the air inlet hole (3213), the inlet valve (323) has an aperture (3231) in a top end thereof, the communication tube (322) includes a flange (3221) on an outer surface thereof so as to be connected to a lower end of the air inlet chamber (3212), the communication tube (322) has a top tube (3224) connected to a top end thereof so as to press the inlet valve (323) against a top end of the air inlet chamber (3212), a lower end of the communication tube (322) has an inner tube connector (3222) which is connected with the inner tube (34) such that the first inlet member (321) communicates with the communication tube (322) to form a water path, the flange (3221) has an aperture (3223) which communicates with the air inlet chamber (3212) and the room (310), the first inlet member (321) and the communication tube (322) are respectively engaged with the body (31), the enlarged opening (3215) and the body presser (3242) press an opening in the top end of the body (31), the hose connector (3211) and the pressing ring (3243) press the hose (2).

7. The device as claimed in claim 5, wherein the two-way switch (4) comprises a hose mount (41), a main part (42), a sealing unit (43) and a release unit (44), the hose mount (41) has a hose connector (411) connected to a lower end thereof so as to be connected with the hose (2), a slot (412) is defined in a top end of the hose mount (41) so as to be secured to the main part (42), a button room (413) is defined between the slot (412) and has a connection hole (414) therein, the main part (42) has an engaging portion (421) at a mediate portion thereof and the engaging portion (421) has a connection tube (4211) which is engaged with the connection hole (414), the connection tube (4211) includes a seal groove (4212) and a sealing ring (42120) is engaged with the seal groove (4212) to seal a gap between the engaging portion (421) and the slot (412), the main part (42) has a mouth piece connector (422) on one side thereof and a release rod (423) is located on the other side of the main part (42), the sealing unit (43) comprises a spring (431), a water valve (432) and a mouth piece (433), the spring (431) and the water valve (432) are engaged within the mouth piece connector (422), the mouth piece (433) is mounted to the mouth piece connector (422) and the water valve (432) contacts against the water outlet hole (4331) of the mouth piece (433) by a force of the spring (431), the water outlet hole (4331) is opened when the mouth piece (433) is compressed, the release unit (44) comprises a cover (441), a button (442), a spring (443), a sealing plug (444), a release collar (445), a release cap (446) and two seals (44220), the button (442) is located in the button room (413) and has an inclined block (4421) protruding from a mediate portion thereof, the cover (441) is securely mounted to outside of the button room (413), one of the seals (44220) is mounted to a seal groove (4422) in a side of the button (442) so as to seal a gap between the button (442) and the cover (441), the spring (443) and the sealing plug (444) are located in the release rod (423), the release collar (445) is securely mounted to the release rod (423) and has a taper-shaped water outlet hole (4451), the sealing plug (444) has an inclined slot (4441) defined in a rear end thereof and the inclined slot (4441) extends beneath the inclined block (4421), the other one of the seals (44420) is engaged with another seal groove (4442) in a front end of the sealing plug (444), the seals (44420) at the front end of the sealing plug (444) is biased by the spring (443) to seal the water outlet hole (4451) of the release collar (445), when the button (442) is pushed, the inclined block (4421) slides along the inclined slot (4441) to move the sealing plug (444) so that the water outlet hole (4451) is opened, the release cap (446) is mounted outside the release collar (445).

8. The device as claimed in claim 5, wherein the mouth piece unit (40) comprises a hose mount (401), a water valve (403), a spring (402) and a mouth piece (404), the hose mount (401) has a hose connector (4011) at a lower end thereof so as to be connected with the hose (2) and a mouth piece connector (4012) is connected to a top end of the hose mount (401), the spring (402) and the water valve (403) are located in the mouth piece connector (4012), the mouth piece (404) is mounted to the mouth piece connector (4012), the water valve (403) is biased by the spring (402) to contact against an outlet of the mouth piece (404) which is opened by compressing the mouth piece (404).

9. A hydration device comprising:

a bag (1) having a water outlet frame (10) connected to an underside thereof and an outlet connector (20) connected to the water outlet frame (10), the outlet connector (20) connected with a first end of a hose (2) and a second end of the hose (2) connected to a first end of a mixing unit (3), a second end of the mixing unit (3) connected with a mouth piece unit (40) or a two-way switch (4), the mixing unit (3) being made of flexible material and having a room (310) defined therein, an inner tube (34) located in the room (310) and connected between a one-way inlet valve (32) and a moisture-water mixing valve (33), the two-way switch (4) comprising a hose mount (41), a main part (42), a sealing unit (43) and a release unit (44), the hose mount (41) having a hose connector (411) connected to a lower end thereof so as to be connected with the hose (2), a slot (412) defined in a top end of the hose mount (41) so as to be secured to the main part (42), a button room (413) defined between the slot (412) and having a connection hole (414) therein, the main part (42) having an engaging portion (421) at a mediate portion thereof and the engaging portion (421) having a connection tube (4211) which is engaged with the connection hole (414), the connection tube (4211) including a seal groove (4212) and a sealing ring (42120) engaged with the seal groove (4212) to seal a gap between the engaging portion (421) and the slot (412), the main part (42) having a mouth piece connector (422) on one side thereof and a release rod (423) located on the other side of the main part (42), the sealing unit (43) comprising a spring (431), a water valve (432) and a mouth piece (433), the spring (431) and the water valve (432) engaged within the mouth piece connector (422), the mouth piece (433) mounted to the mouth piece connector (422) and the water valve (432) contacting against the water outlet hole (4331) of the mouth piece (433) by a force of the spring (431), the water outlet hole (4331) opened when the mouth piece (433) is compressed, the release unit (44) comprising a cover (441), a button (442), a spring (443), a sealing plug (444), a release collar (445), a release cap (446) and two seals (44220), the button (442) located in the button room (413) and having an inclined block (4421) protruding from a mediate portion thereof, the cover (441) securely mounted to outside of the button room (413), one of the seals (44220) mounted to a seal groove (4422) in a side of the button (442) so as to seal a gap between the button (442) and the cover (441), the spring (443) and the sealing plug (444) located in the release rod (423), the release collar (445) securely mounted to the release rod (423) and having a taper-shaped water outlet hole (4451), the sealing plug (444) having an inclined slot (4441) defined in a rear end thereof and the inclined slot (4441) extending beneath the inclined block (4421), the other one of the seals (44420) engaged with another seal groove (4442) in a front end of the sealing plug (444), the seals (44420) at the front end of the sealing plug (444) being biased by the spring (443) to seal the water outlet hole (4451) of the release collar (445), when the button (442) is pushed, the inclined block (4421) slides along the inclined slot (4441) to move the sealing plug (444) so that the water outlet hole (4451) is opened, the release cap (446) is mounted outside the release collar (445).

10. The device as claimed in claim 9, wherein the one-way inlet valve (32) comprises a first inlet member (321), a communication tube (322), an inlet valve (323) and a collar (324), a hose connector (3211) is connected to a top end of the first inlet member (321) and an air inlet chamber (3212) is connected to a lower end of the first inlet member (321), the air inlet chamber (3212) has outer threads (3214) defined in an outer surface thereof and an air inlet hole (3213) is defined through a wall of the air inlet chamber (3212), an enlarged opening (3215) is defined in an underside of the air inlet chamber (3212), the collar (324) has a communication hole (3244) defined in a mediate portion thereof and inner threads (3241) are defined in an inner periphery thereof, a pressing ring (3243) and a body presser (3242) are connected to a top end and a lower end of the collar (324), the air inlet chamber (3212) is engaged with the inlet valve (323) so as to seal the air inlet hole (3213), the inlet valve (323) has an aperture (3231) in a top end thereof, the communication tube (322) includes a flange (3221) on an outer surface thereof so as to be connected to a lower end of the air inlet chamber (3212), the communication tube (322) has a top tube (3224) connected to a top end thereof so as to press the inlet valve (323) against a top end of the air inlet chamber (3212), a lower end of the communication tube (322) has an inner tube connector (3222) which is connected with the inner tube (34) such that the first inlet member (321) communicates with the communication tube (322) to form a water path, the flange (3221) has an aperture (3223) which communicates with the air inlet chamber (3212) and the room (310), the first inlet member (321) and the communication tube (322) are respectively engaged with the body (31), the enlarged opening (3215) and the body presser (3242) press an opening in the top end of the body (31), the hose connector (3211) and the pressing ring (3243) press the hose (2).

11. The device as claimed in claim 9, wherein the moisture-water mixing valve (33) comprises a second inlet member (331), a connection member (332), a mixing valve (333) and a collar (334), the second inlet member (331) has an inner tube connector (3311) connected to a top end thereof so as to be connected with the inner tube (34), a mixing chamber (3312) is connected to a lower end of the second inlet member (331) and includes an inlet hole (3313) defined therein and an insertion portion (3314) is located at a mediate portion of the mixing chamber (3312), the mixing valve (333) is mounted to the insertion portion (3314) so as to seal the inlet hole (3313), the connection member (332) has an annular portion (3321) on a top end thereof and outer threads (3323) are defined in a mediate portion of the connection member (332), a hose connector (3322) is connected to a lower end of the connection member (332), the collar (334) includes inner threads (3341) defined therein and a body presser (3342) is connected to a top end of the collar (334), a pressing ring (3343) is connected to a lower end of the collar (334), the second inlet member (331) is engaged within the annular portion (3321) which is engaged with the lower end of the body (31), when the connection member (332) is threadedly connected to the collar (334), the annular portion (3321) and the body presser (3342) press an opening in the lower end of the body (31), and the hose connector (3322) and the pressing ring (3343) press the hose (2).

12. The device as claimed in claim 9, wherein the mouth piece unit (40) comprises a hose mount (401), a water valve (403), a spring (402) and a mouth piece (404), the hose mount (401) has a hose connector (4011) at a lower end thereof so as to be connected with the hose (2) and a mouth piece connector (4012) is connected to a top end of the hose mount (401), the spring (402) and the water valve (403) are located in the mouth piece connector (4012), the mouth piece (404) is mounted to the mouth piece connector (4012), the water valve (403) is biased by the spring (402) to contact against an outlet of the mouth piece (404) which is opened by compressing the mouth piece (404).

* * * * *